United States Patent [19]

O'Malley

[11] Patent Number: 4,468,904

[45] Date of Patent: Sep. 4, 1984

[54] MULTI-STAGE EXTENDABLE TOWER

[76] Inventor: James J. O'Malley, 8011 NW. 35th Ct., #3, Coral Springs, Fla. 33065

[21] Appl. No.: 484,856

[22] Filed: Apr. 14, 1983

[51] Int. Cl.[3] ..... B66C 23/06

[52] U.S. Cl. ..... 52/111; 52/113; 52/121; 254/364

[58] Field of Search ..... 52/111, 121, 122, 113, 52/118, 114, 125, 123, 67, 632; 254/364

[56] References Cited

U.S. PATENT DOCUMENTS

| | | | |
|---|---|---|---|
| 2,243,940 | 6/1941 | Ball | 254/364 |
| 2,481,037 | 9/1949 | Pringle | 254/364 X |
| 2,675,211 | 4/1954 | Regoord | 52/121 X |
| 2,692,169 | 10/1954 | Phillips | 52/121 |
| 3,359,559 | 12/1967 | Guinn | 52/113 X |
| 3,555,748 | 1/1971 | Herman | 52/121 |
| 3,848,703 | 11/1974 | Rundle | 52/121 X |
| 4,003,552 | 1/1977 | Sobolewski | 254/364 X |

*Primary Examiner*—J. Karl Bell

*Attorney, Agent, or Firm*—Malin, Haley & McHale

[57] ABSTRACT

A multi-stage extendable tower for controlled elevated support and positioning of workmen and equipment having a plurality of telescoping frame sections that may be raised from a collapsed nested position to a partially or fully extended position. Functionally positioned and interconnected between each adjacent frame section is at least one heavy-duty coiled spring whose potential energy stored in torsion provides sufficient lifting force to overcome the weight of the above frame members, workmen and equipment. Both manual and motorized means are disclosed and claimed for effecting compression and renesting of the frame members.

12 Claims, 13 Drawing Figures

MULTI-STAGE EXTENDABLE TOWER

BACKGROUND OF THE INVENTION

This invention relates generally to movable towers for facilitating construction and maintenance work at elevated heights and more particularly to collapsible, nestable towers.

Extendable towers are well known in the construction, servicing, maintenance, and lighting tower industry. Collapsibility has facilitated portability and versatility in the range of useful heights of these towers. Heretofore, various pressurized cylinder means have been employed as the moving force for extending and collapsing or compressing the individual telescoping frame members. These pressurized extendable cylinders require either an external source of compressed fluid or a compressor or fluid pump for activation. Such towers are disclosed in U.S. Pat. Nos. 3,958,376, 3,099,332, and 3,752,261. The added expense for these cylinders represents a considerable added portion to the total price. Scissors-type linkage, as disclosed in U.S. Pat. No. 3,700,070 is an alternate mode of raising and lowering a work platform. However, this device also incorporates pressurized telescoping cylinders as the prime mover.

The present invention discloses a new and improved multi-stage telescoping tower having, as its prime moving source of power at least one helix wrapped torsion spring functionally interconnected between adjacent telescoping frame members. After a height control means is used to position the height of the upper work platform at a desired level, a locking means then positively holds that level until the user releases the locking means and repositions the work surface. This height control means may be power operation.

BRIEF DESCRIPTION OF THE INVENTION

A multi-stage extendable tower for controlled elevated support and positioning of workmen and equipment, the tower having a plurality of telescoping frame sections that may be raised from a collapsed nested position to a partially or fully extended position. Functionally positioned and interconnected between each adjacent frame section is at least one heavy-duty coiled spring whose potential energy stored in torsion provides sufficient lifting force to overcome the weight of the above frame members, workmen and equipment. Both manual and motorized means are disclosed and claimed for effecting compression and renesting of the frame members. Each coiled torsion spring may be sized and pretensioned to exactly counterbalance a predetermined fixed payload on the upper work platform or may be sized and pretensioned to enable lifting up to a certain maximum load. In the latter situation, a height control means is required to provide intermediate work platform positioning. Lockable wheels and casters may be included to aid portability to as many telescoping, nesting sections as required.

It is therefore an object of this invention to provide an improved telescoping, extendable work tower having economical helix-wound at least one coil spring as the source of power for extending the nested tower frame sections.

It is another object of this invention to provide the above tower having coil springs sized and pretensioned to enable either a fixed or up to a maximum payload.

It is still another object of this invention to provide the above tower for elevating a maximum preselected payload and having a height control means for positioning the height of the work surface at any desired intermediate level.

It is yet another object of this invention to provide an improved telescoping, extendable lighting tower having economical helix-wound at least one coil spring as the source of power for extending the nested tower frame sections.

In accordance with these and other objects which will be apparant hereinafter, the instant invention will now be described with particular reference to the accompanying drawings.

PREFERRED EMBODIMENT OF THE INVENTION

Figure 1:
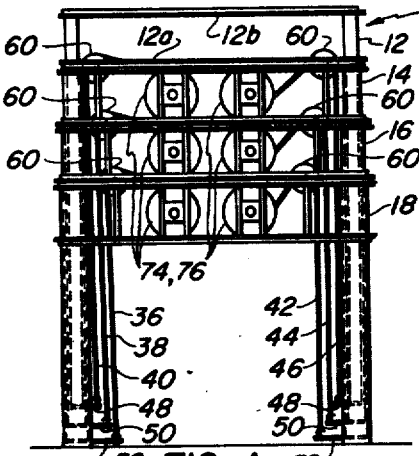
FIG. 1 is a left end elevation view of the invention in the compressed position.
Figure 2:
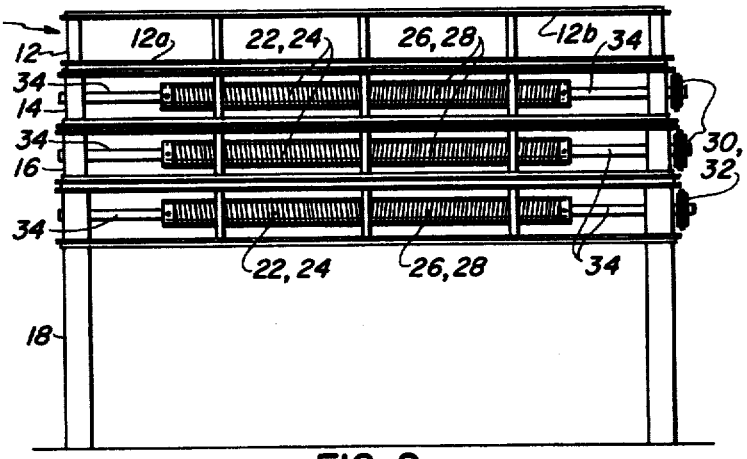
FIG. 2 is a front elevation view of the invention in the compressed position.

Referring now to the drawings and particularly to FIGS. 1 and 2, the invention is shown generally at 10 and includes a plurality of telescoping frame members 12, 14, 16 and 18. Each frame member has a set of four vertical legs, one at each corner. Each set of legs is sized to telescope within the next larger-sized hollow set below. The invention in FIGS. 1 and 2 is shown fully compressed with each frame member nested a maximum within the supportive one below. The uppermost frame member 12 includes a planar work surface **12*a* and cross-strut 12*b* connected thereabove for additional strength, a removable handrail (not shown) is optionally attachable to the cross strut 12*b***.

Figure 8:
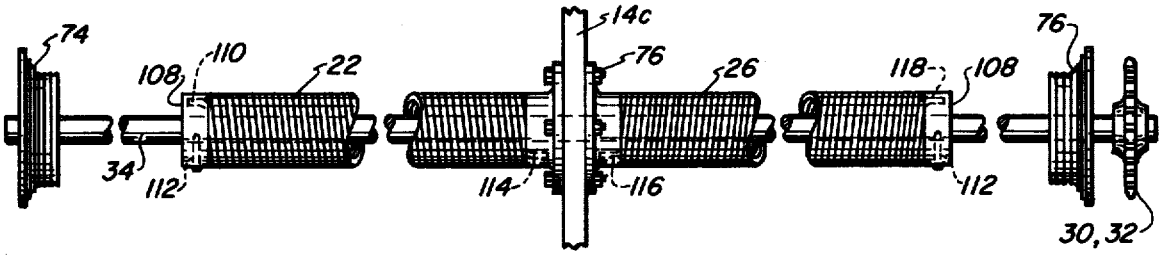
FIG. 8 is a partial front elevation view of the helix springs, sprocket, and pulleys of one half of the preferred lifting mechanism.

Still referring to FIGS. 1 and 2, each means for telescopically extending one frame member within another to effect raising and lowering of the work surface **12*a* includes two pair of helix wound coil springs 22, 24 and 26, 28, each pair mounted on a shaft 34. The shafts 34 are held for rotation about their longitudinal axis by bearings connected to each end of a different frame member 14, 16 or 18. Referring also to FIG. 8, the end of each spring 22, 24, 26 and 28** positioned at the center 14c of the frame member is prevented from rotating relative to the frame member by tangs 114 and 116. The outer ends of the springs are fixed in collars 112 by tangs 110 and 118, which collars are fixed to shafts 34 by pins 112. Therefore, rotation of the shaft 34 has the effect of varying the torsional energy stored in both springs mounted over that shaft because the springs are of opposite winding. Also connected to each shaft 34 are cable drums 74 and a chain sproket 30 or 32 spaced apart conveniently near the shaft ends as shown in FIG. 8.

Figure 7:
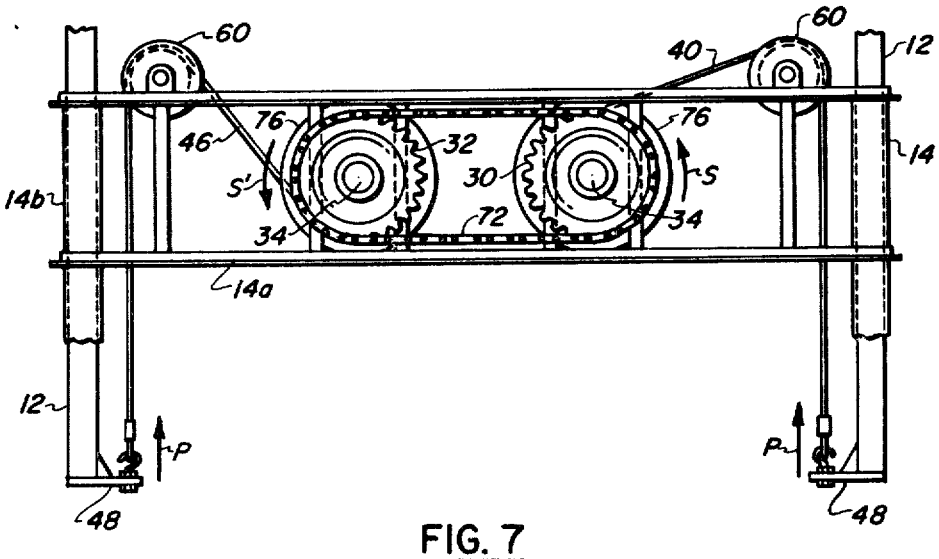
FIG. 7 is a partial right end elevation view of the preferred lifting mechanism.

As best seen in FIG. 7, connected to and wrapped around each cable drum 76 is a length of cable 36, 38, 40, 42, 44 or 46 which feeds around a direction change pulley 60 along an intermediate portion of each length of cable. The other end of each length of cable is connected to a different leg of the frame member which telescopes within the frame member to which that cable is connected via cable drum 76. The sprockets 30 and 32 are interconnected by a loop of chain 72 such that the two sprockets 30 and 32 rotate in equal and opposite directions S and S' in relation to movement of cable brackets 48 in direction P. By this arrangement, uniform vertical telescoping movement is achieved without undue binding or instability.

Figure 3:
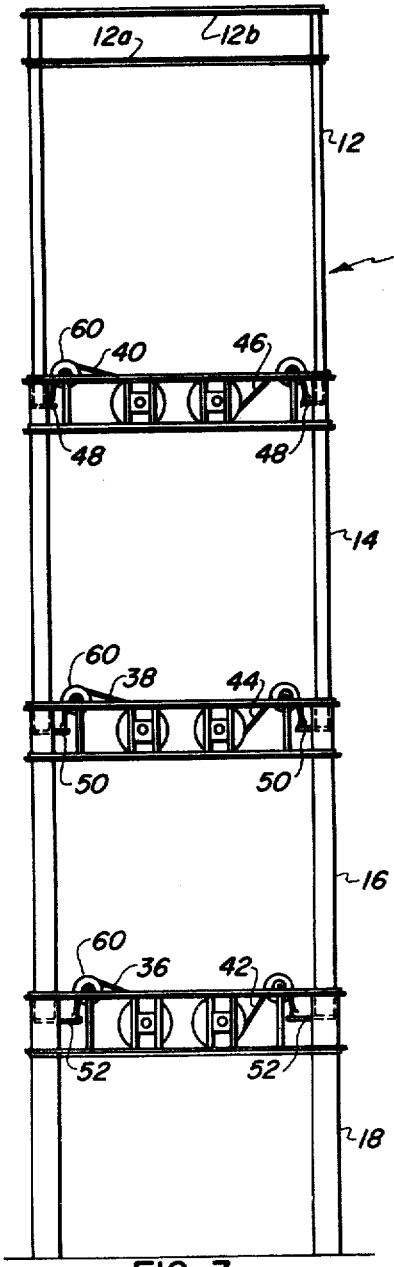
FIG. 3 is a left end elevation view of the invention in the fully telescoped, extended position.
Figure 4:
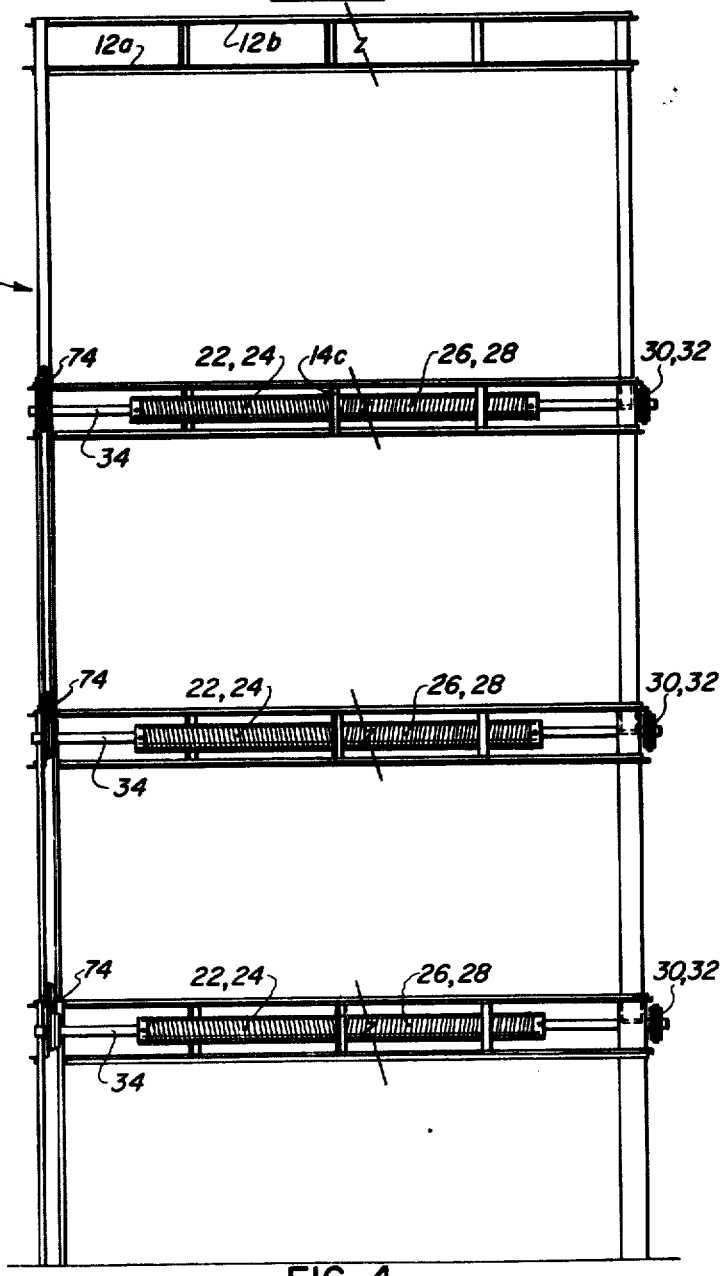
FIG. 4 is a partial section front elevation view of the invention in the fully telescoped, extended position.
Figure 5:
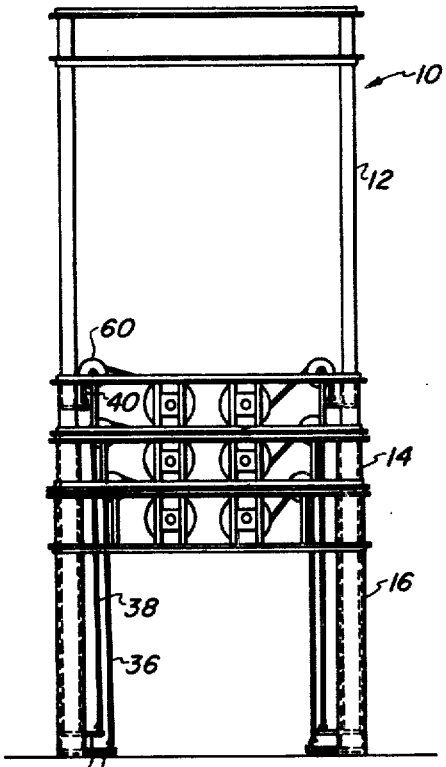
FIG. 5 is a left end elevation view of the invention in a first partially telescoped, extended position.
Figure 6:
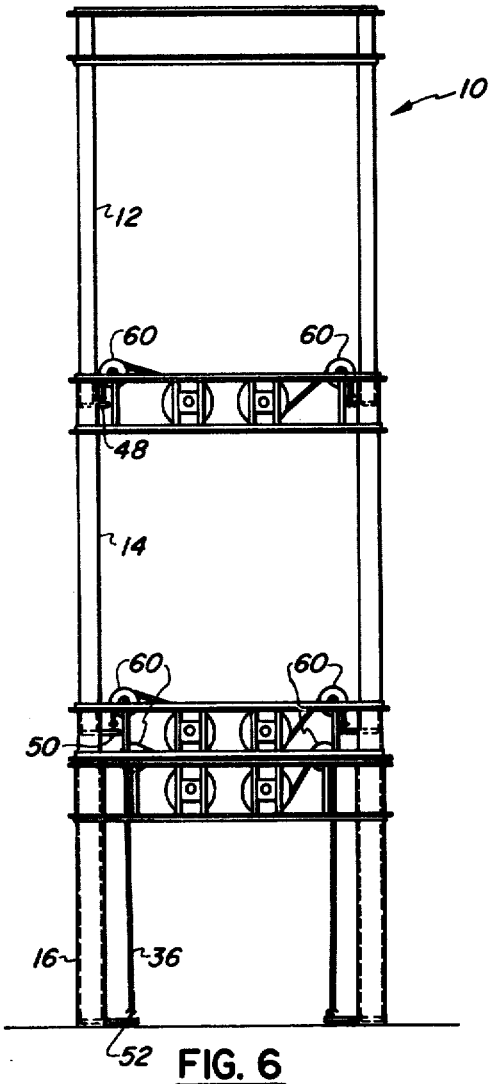
FIG. 6 is a left end elevation view of the invention in a second partially telescoped, extended position.

The unique above-described design of helix springs 22, 24, 26 and 28 provides the power required to fully or partially extend the tower from the fully compressed positions as in FIGS. 1 and 2 to a partially telescoped, extended position shown in FIGS. 5 and 6 and to the fully extended position shown in FIGS. 3 and 4. By preselecting the sizes for the springs and proper pretensioning those springs 22, 24, 26 and 28 upon assembly of the springs onto the shafts 34 into the frame members 14, 16 and 18, the desired frame lifting force is applied to cables at cable brackets 48, 50, and 52.

Figure 13:
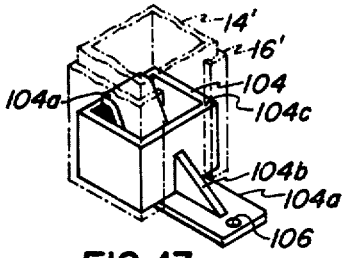
FIG. 13 is a perspective view of a preferred leg insert stop which includes a cable attachment.
Figure 9:
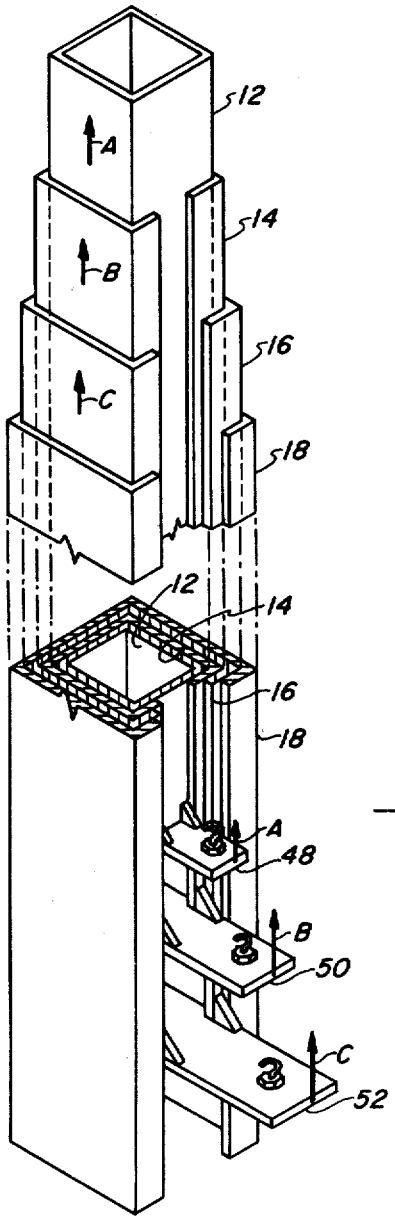
FIG. 9 is an isometric view of one corner of the telescoping frame members.

FIG. 9 best depicts the structural interrelationship between the telescoping legs of frame members 12, 14, 16 and 18 in relation to the cable brackets 48, 50 and 52. These brackets are respectively connected to the legs of frame members 12, 14 and 16. Thusly upward movement of cable bracket 48 an amount A directly results in frame member 12 moving upward an equal amount A and similarly for the others. The slots in the common sides of legs of frame members 14, 16 and 18 as shown provide clearance for relative vertical movement of cable brackets 48, 50 and 52. The preferred structure for the cable brackets is shown in FIG. 13 connected to frame stop tube 104. This stop is mounted within each leg (here 16') at its lower end. End surface 104c then serves as a positive stop for the next above frame leg 14 therein. Cable bracket 104a is shaped to gain maximum support from two separate connections to stop 104 as shown. Each cable is connected to the cable bracket at aperture 106.

Because each successively lower pair of springs must enable lifting the weight of an additional frame member, the pretensioning and/or spring sizing must be properly selected. Additionally, this pretensioning and spring sizing will determine the maximum liftable payload and may also regulate the sequence of frame member extension. As shown between FIGS. 5 and 6, the preferred order is to have the highest frame member fully extend before the next lower frame member begins to move upwardly.

Under ideal conditions of free telescoping and spring sizes and pretensioning, only a very small amount of force would be required to extend or compress the tower frame members. Further, this ideal situation would only apply to a fixed payload weight. To minimize further the force necessary to vary, cable drums 74 have cable grooves of decreasing diameter such that, as the next higher frame member is raised and the helix springs unwind and decrease in further lifting capacity, that decrease is approximately compensated for by the cable drums 74. This load compensation occurs as more cable is wound onto the pulley, wrapping to the next smaller grooves, thus increasing mechanical advantage.

Figure 10:
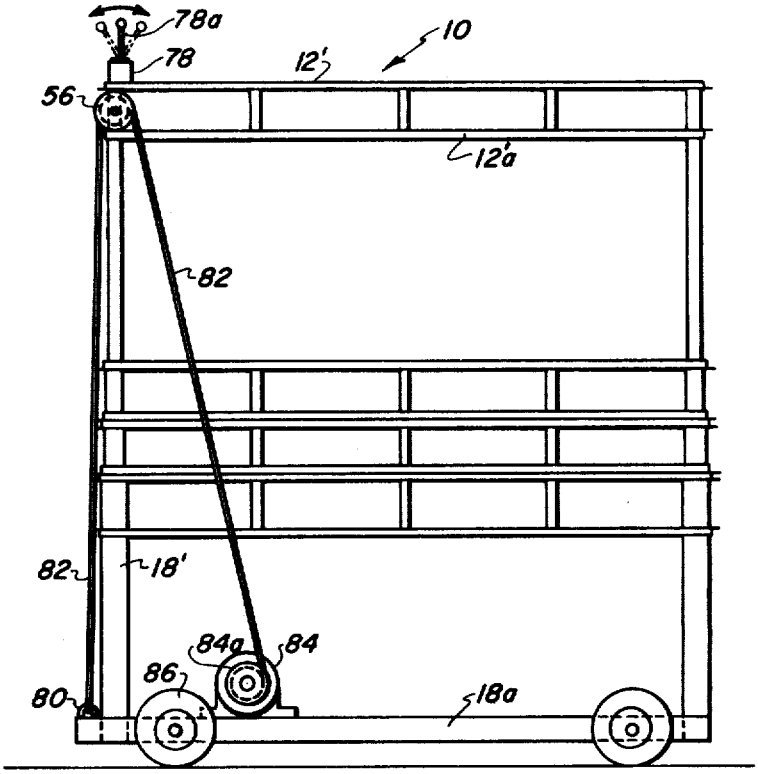
FIG. 10 is a simplified front elevation view of an alternate embodiment of the invention including motorized vertical height control means.

More practically, since small errors or binding could cause lifting to be inhibited, the amount of lifting force produced by the pairs of helix springs is set slightly higher than required. Positioning and thusly height adjustment is controlled as shown in FIG. 10. Cable 82 is connected at one end to the lowest frame member 18' at 80 and is wrapped around the cable drum 84a driven by winch motor 84 which may be electric or manually propelled. The mid-portion of cable 82 wraps over pulley 56 which is connected for free rotation to the uppermost frame member 12'. Rotation of motor 84 and cable drum 84a, controlled by switch 78 via lever 78a, varies the length of cable 82, the height of pulley 56, and thusly, the height of work surface 12a. Helix spring pairs (not shown in this figure) are pretensioned to effect said desired telescoping and elevation of the frame members serially from highest to lowest. Wheels 86 connected to the lowest frame member 18' add portability. Wheel locks and casters may also be added.

Figure 11:
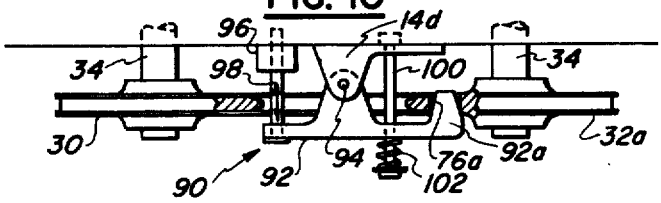
FIG. 11 is a top partial section view of the brake or position-holding means.
Figure 12:
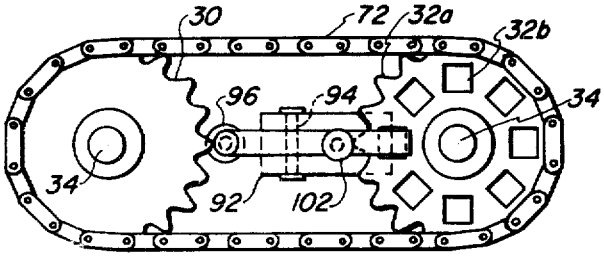
FIG. 12 is a right end elevation view of the brake or position-holding means shown in FIG. 11.

A brake mechanism 70 is shown in FIGS. 11 and 12 so that a particualar work platform height may be maintained regardless of payload fluctuation. The brake 90 interacts between each frame member and one sprocket 32a. Pawl 92, controllably pivotable about mounting shaft 94 by solenoid 96, enters apertures 32b in sprocket 32a. Spring 102 applies sufficient pressure when solenoid 96 is deenergized to maintain pawl portion 92a engagement into one of the apertures 36b and thus to hold any desired relative position between adjacent frame members. The brake 90 is released by reactivating solenoid 96.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A multi-stage extendable tower comprising:

a plurality of frame members each adapted to telescope vertically within adjacent said frame members from a minimum height to a maximum working height;

the lowest frame member of said plurality of frame members when said tower is vertically extended being adapted to support said tower on a generally level surface;

the highest frame member of said plurality of frame member of said plurality of frame members when said tower is vertically extended being adapted to support a useful weight; and a plurality of torsion spring means for vertically extending and telescoping said plurality of frame members to elevate said useful weight to a particular height up to and including said maximum working height;

each said torsion spring means connected between adjacent said frame members;

each said plurality of torsion spring means includes at least one elongated cylindrical helix spring connected at one end to one said adjacent frame member, the other end of each said helix spring connected to a cable drum; and a length of cable connected at one end to the other said adjacent frame member, the other end of said cable connected to said cable drum.

2. A multi-stage extendable tower as set forth in claim 1, wherein:

each said frame member of said plurality of frame members includes a plurality of vertical legs;

said plurality of legs for said vertical telescoping of said adjacent frame members.

3. A multi-stage extendable tower as set forth in claim 1, further including:

vertical height control means for controlling the height of said highest frame member by regulating the amount of said telescopic vertical extension of said plurality of frame members;

said vertical height control means also for compressing said plurality of frame members to a fully nested and minimum height position.

4. A multi-stage extendable tower as set forth in claim 3, wherein said vertical height control means includes:

a length of cable connected at one end to said lowest frame member;

winch means connected to said lowest frame member and the other end of said cable;

said winch means for varying the length of said cable;

said cable adapted to engage around a pulley connected to said highest frame member.

5. A multi-stage extendable tower as set forth in claim 1, wherein:

said pulley has a plurality of increasingly smaller diameter adjacent grooves for providing uniform said adjacent frame member intension force as each said at least one helix spring unwinds.

6. A multi-stage extendable tower as set forth in claim 1, wherein each said at least one torsion spring means includes:

two adjacent elongated cylindrical helix springs each connected at one end to one said adjacent frame member, the other end of each said helix spring connected to a cable drum;

at least two lengths of cable each connected at one end to the other said adjacent frame member, the other end of each said cable connected to one said cable drum; and chain and sprocket means interconnected between said two adjacent helix springs for making winding and unwinding of both said helix springs substantially the same.

7. A multi-stage extendable tower as set forth in claim 1, further comprising:

brake means for releasably fixing any particular overall tower height.

8. A multi-stage extendable tower as set forth in claim 6, further comprising:

brake means for releasably fixing any particular overall tower height;

said brake means having a pawl pivotally connected to each said frame member for releasable engagement to one said sprocket;

said engagement locking the rotational position of said chain and sprocket means.

9. An extendable tower comprising:

three or more vertically disposed frame sections, said frame sections adapted to telescope vertically within one another;

a plurality of torsion springs, one each of said plurality of torsion springs being associated with and attached to two distinct portions of a respective one of said frame sections;

the unwinding of each said torsion spring being effective to vertically extend said respective one of said frame members a predetermined vertical distance, whereby to vertically extend said tower.

10. The tower of claim 9, wherein the torsional potential energy of said one each of said plurality of torsional springs is preselected so that said potential energy is greater than or equal to the potential energy necessary to vertically extend said respective one of said frame sections and the portion of said tower disposed vertically above said one each of said plurality of torsional springs along said predetermined vertical distance associated with said respective one of said frame sections, plus the potential energy necessary to statically support said respective one of said frame sections and said portion of said tower disposed vertically above said one each of said plurality of torsional springs.

11. The tower of claim 9, wherein said one each of said plurality of torsional springs comprises at least two oppositely wound torsion springs, each said at least two oppositely wound torsion springs being effective to rotate an associated sprocket wheel, all said sprocket wheels of each said frame being connected together by a sprocket wheel chain, each said sprocket wheel having an associated pulley wheel rotatably fixed to each said sprocket wheel, each said pulley of each said frame effective to move an associated pulley cable, and end of each said pulley cable of each said frame being fixed to said frame, whereby to provide uniform vertical telescoping of said frames within one another.

12. The tower of claim 10, wherein said one each of said plurality of torsional springs comprises at least two oppositely wound torsion springs, each said at least two oppositely wound torsion springs being effective to rotate an associated sprocket wheel, all said sprocket wheels of each said frame being connected together by a sprocket wheel chain, each said sprocket wheel having an associated pulley wheel rotatably fixed to each said sprocket wheel, each said pulley of each said frame effective to move an associated pulley cable, and end of each said pulley cable of each said frame being fixed to said frame, whereby to provide uniform vertical telescoping of said frames within one another.

* * * * *